United States Patent [19]

Magnusson

[11] 4,012,985

[45] Mar. 22, 1977

[54] MULTIPLE LAUNCHER

[76] Inventor: Arnold Ingemar Magnusson, Bergfinksvagen 2, S-140 32 Grodinge, Sweden

[22] Filed: Feb. 26, 1975

[21] Appl. No.: 553,409

[30] Foreign Application Priority Data

Feb. 27, 1974 Norway ..... 740676

[52] U.S. Cl. ..... 89/1.818; 89/1 F; 102/49.7; 102/63

[51] Int. Cl.[2] ..... F41F 3/04

[58] Field of Search ..... 42/1 F; 89/1 F, 1 L, 89/1.8, 1.813, 1.816, 1.818; 102/49.7, 63

[56] References Cited

UNITED STATES PATENTS

| | | | |
|---|---|---|---|
| 1,276,689 | 8/1918 | Poudrier | 89/1 F |
| 1,311,780 | 7/1919 | Stone | 89/1 F |
| 1,376,320 | 4/1921 | Crowe | 89/1 F X |
| 2,351,257 | 6/1944 | Formhals | 89/1 L UX |
| 3,319,522 | 5/1967 | Gould et al. | 89/1.816 X |
| 3,364,817 | 1/1968 | Barton | 102/49.7 X |
| 3,643,545 | 2/1972 | Nahas | 89/1 F |
| 3,702,090 | 11/1972 | Hoard | 89/1.816 X |

FOREIGN PATENTS OR APPLICATIONS

| | | | |
|---|---|---|---|
| 491,948 | 6/1919 | France | 89/1 F |

*Primary Examiner*—David H. Brown
*Attorney, Agent, or Firm*—Pollock, Vande Sande & Priddy

[57] ABSTRACT

A multiple barrel launcher for simultaneous launching of a number of projectiles by means of gas generated by a propellant charge placed in a pressure cartridge in communication with said barrels via a pressure chamber, wherein the communication comprises channels between each of the barrels and the pressure chamber, each of these channels being so dimensioned in relation to the charge that a critical driving gas flow velocity is obtained during the launching course.

3 Claims, 5 Drawing Figures

MULTIPLE LAUNCHER

Figure 1:
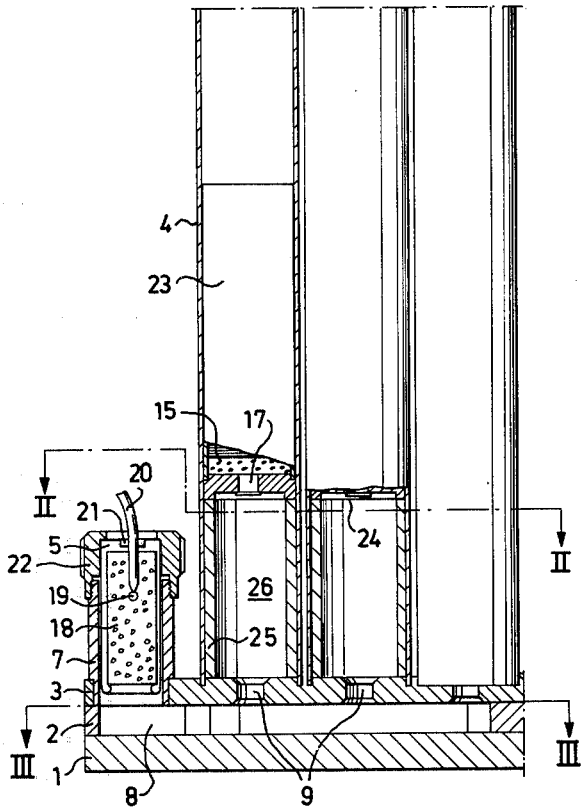

For the protection of vessels against radar target tracking missiles and aircraft, strips or needles (chaff) of a reflecting material, e.g. aluminum, are used, which strips in large quantities are dispersed at a suitable height between the attacking missile and the vessel. The purpose is that the hostile target tracker shall lock on the strip cloud instead of locking on the vessel. In order to achieve this result the radar target area of the cloud shall preferably be as great as (or greater than) that of the vessel, and the reflection capability of the cloud is to be developed as quickly as possible after launching.

The dispersion of the strips is difficult to achieve, since the strips have a very large air drag relative to their weight. Even if they are given a high spreading velocity, the strips will in a few meters have been slowed down to zero velocity, whereupon the actual dispersion will be solely dependent upon wind and air currents.

The methods which have been tested in the past to improve the dispersion (e.g., exploding pyrotechnical charges, rocket beams, propulsion with the aid of springs and the like) have turned out to be effective only insofar as they more or less prevent the strips from caking into lumps.

The only possibility of dispersing the strips through a greater volume in space is therefore to eject a great number of strip packages which are scattered as required. This can be done with the aid of a shell or the like, which at a desired height is broken up into a greater number of sub-parts each delivering a number of strips. The other possibility is to launch a great number of projectiles, shells or rockets, which are given different trajectories, so that their strip charges are dispersed through an air volume of desired magnitude. It is also possible to use a combination of these methods.

In the last mentioned cases, a greater number of projectiles must simultaneously be given the velocity required for them to reach the desired height. This can be done by means of rocket motors, by firing the projectile from a barrel, or by a combination of these two propulsion techniques. If rockets are used the initial velocity must be sufficient, i.e. more than 50 meters per second, for the rockets not to veer too much by vane-affect when they are subjected to the streams of ambient air, e.g., due to free-stream velocity.

Whatever the method used, each unit must be provided with a pyrotechnical igniter, which is actuated electrically. This in turn requires that a large number of electrical conductors be connected for each reloading. In order to assure contact in the difficult shipboard environment, they must be connected by soldering, which in practice precludes re-loading at sea.

The present invention seeks to overcome this problem by making it possible for a plurality of projectiles to be launched nearly simultaneously. The invention thus concerns a launcher with multiple barrels for nearly simultaneous launching of two or more projectiles by means of propellant gas generated by a propellant charge, the propellant charge being situated in a pressure cartridge common to several barrels, said cartridge being in communication with the barrels via a pressure chamber. The invention is characterized in that the communication between the barrels and the pressure chamber comprises channels individual to the barrels, the channels being so shaped and dimensioned in relation to the charge of the pressure cartridge that the driving gas flow generated by this charge reaches critical velocity during at least part of the launching course.

In this manner the projectile velocities will be fairly independent of temperature variations and the courses in the various barrels affect each other only to a minor extent, even though only one or a few of the barrels are loaded with projectiles. A controlled firing of the projectiles is thus ensured independently of differences between them, and it will even be possible e.g., for training purposes, to use only a minor number of said barrels for launching projectiles, without the need to take any special steps with regard to the unused barrels.

Due to the fact that the projectiles may be allowed to have different weights, it is also possible to have certain projectiles contain IR jamming means such as torches or similar pyrotechnical charges.

Figure 4:
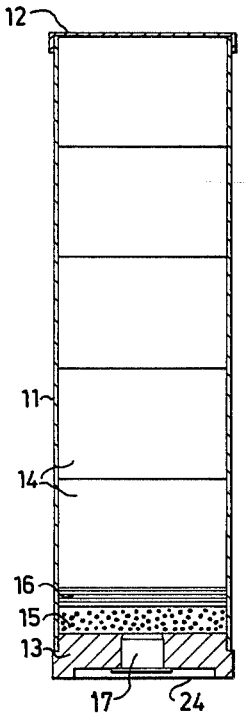
Figure 2:
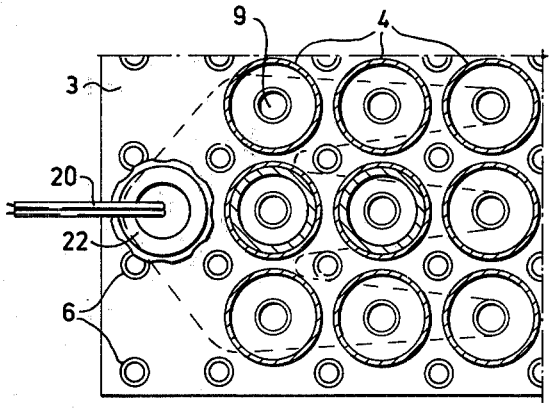
Figure 3:
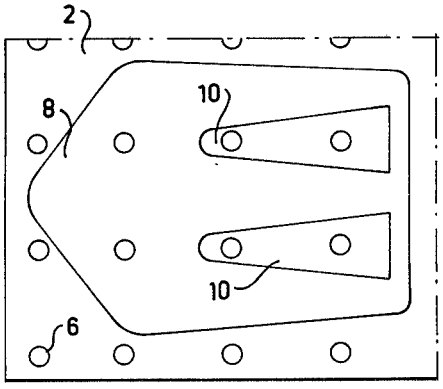
Figure 5:
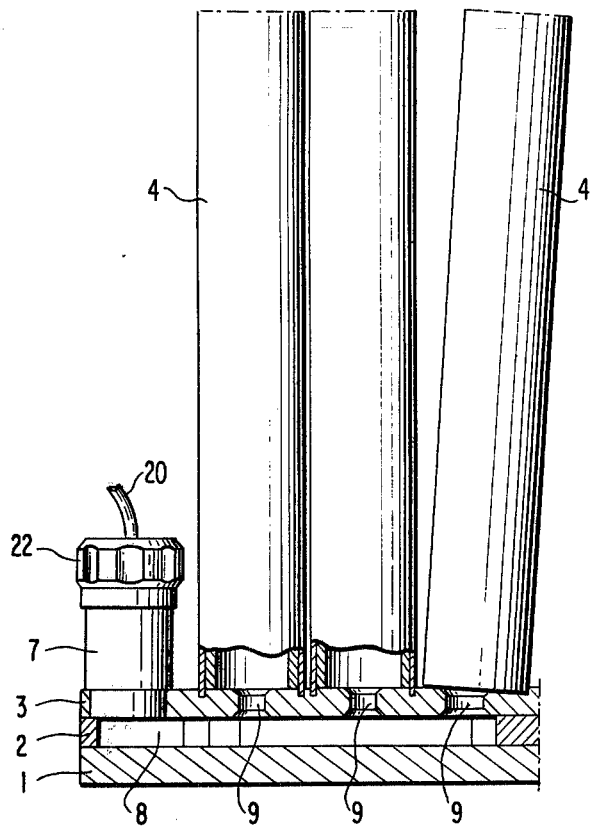

The invention will now be described with reference to FIGS. 1 to 5 of the accompanying drawings, in which FIG. 1 shows a side view of a launcher, FIG. 2 a plan view, FIG. 3 is a section through the base block, FIG. 4 is a suggested strip grenade and FIG. 5 is a side view similar to FIG. 1, but with the rightmost barrel having a larger channel and deviating from the vertical orientation of the other barrels.

A launcher comprises a base block 1,2,3, in which an arbitrary number of barrels 4 are attached. In FIG. 1 only a corner portion of a launcher is shown, having nine barrels, which are fired simultaneously upon the ignition of the igniter or pressure cartridge 5, since they are all in communication with the cartridge. The number of groups in each launcher as well as the number of rockets in a group depends only on the number of strips to be distributed during each volley.

The base block in the illustrated embodiment consists of three plates 1,2,3 suitably made of anodized light metal and fastened together by bolts 6. The barrels 4 are attached to the uppermost or top plate 3 of said plates in substantially upright position, and so is the container 7 for cartridge 5. In the intermediate plate 2 there is provided a cavity 8 forming a pressure chamber so that communication will exist between the igniter 5 and channels 9 drilled in top plate 3 beneath each barrel 4. In the pressure chamber there are disposed two guide rails 10 for distributing the gas to the nine barrels. The lowermost or bottom plate 1, in which there are holes for the attachment bolts 6, may be provided with fastening means (not shown) for attachment to the deck of a vessel.

The strip shell shown in FIG. 4 comprises a cylindrical casing 11 provided with a cap 12 and reinforced bottom part 13. The strip load is placed in the form of bundles 14 within the shell. Below the strips a space is reserved to serve as a container for a pyrotechnical charge 15 for delivering, when ignited, the propellant gas needed to force strips 14 out of casing 11. The strips are protected against the combustion gases by e.g., a felt disc 16. The ignition of the pyrotechnical charge 15 takes place via a time delay element 17 containing, for instance, a gasless pyrotechnical delay charge.

At the bottom of barrel 4 there is disposed a distance sleeve 25, against which the projectile rests with its trailing plane 24. This distance sleeve thus defines a free space 26 between the mouth of channel 9 and the trailing end 24 of the projectile 23. This space should suitably have a length in the barrel at least equal to the diameter of same, preferably of the order of twice said diameter. This limits the maximum pressure, thereby reducing the demands on the mechanical strength of the projectile, and the projectile may be made lighter than would be the case if the projectile were situated with its trailing end 24 immediately adjacent to the mouth of channel 9.

The pressure cartridge 5 consists of a casing of, e.g., metal or plastic, which serves as a container for the propellant 18. The choice of this medium depends on the pressure desired in the barrels, which pressure in the first place depends on the weight of the shell and the desired initial velocity, and may advantageously be a propellant consisting of granulated boron-potassium nitrate. The ignition of the propellant may take place mechanically by means of a primer or, as in the illustrated example, by means of an electric squib 19, the connecting wires 20 of which are drawn through a gas-tight aperture 21 in the bottom of the cartridge. The latter is kept in position by a nut 22.

The operation of the launcher is as follows:

Nine rockets or shells 23, e.g., according to FIG. 4, containing a desired number of strips, are placed in the barrels, one in each barrel. The pressure cartridge 5, containing a suitable quantity of power medium 18, is secured in the container 7 provided for this purpose. At the desired moment, a current source is connected to wires 20, causing the propellant to be ignited by initiator 19. The combustion gases flow through the pressure chamber 8 and the channels 9 in top plate 3 into the barrels 4, where said gases develop the pressure for accelerating the projectiles 23 to a desired initial velocity. During the passage in the barrels the gasless charge of delay element 17 also is ignited, which charge is burnt through after a time dependent on the burning length, and ignites the pyrotechnical charge 15 ejecting the strips from the container to the desired altitude.

Normally a sufficient dispersion of the shells a lateral direction is obtained, due to the fact that they influence each other at the firing. If a greater dispersion should be desirable, this can be effected by giving the barrels different elevations.

The operation will be similar when firing rockets. The motors of these are then ignited by the hot gas in the barrel.

The dimensions of the channels 9 in top plate 3 will determine the magnitude of the pressure developed in the barrels and thereby the initial velocities of the projectiles. The total area of the holes must always be less than the total flow area of the pressure chamber. The fact that the holes form chokes assures that critical flow is obtained in channels 9 during the major part of the course, whereby the temperature dependence on the initial velocity is simultaneously reduced since the course in one barrel as already mentioned is not appreciably influenced by the courses in the others. Furthermore, the initial velocity of the projectiles may be varied by varying the dimensions of the passage holes in accordance with a predetermined pattern (see FIG. 5), so that a strip cloud will be given a predetermined shape, e.g., a conical shape, which has turned out to be of great importance for its reflecting capacity. To this end the barrels may have divergent elevations.

In order to bring about the said free space in the loaded position of the projectile, it is also possible to have the shell wall project some distance below its bottom part having the delay fuse 17 (or corresponding means) disposed therein. It is obvious that the distance means may instead be, e.g., an annular ridge, one or more studs, or the like.

What I claim is:

1. Apparatus for launching a plurality of projectiles, comprising a. a cavity having bottom, side and top wall portions;

b. a receptacle in communication with the cavity for receiving a cartridge providing on its explosion a gas pressure in the cavity;

c. a plurality of barrels for receiving projectiles, the barrels being mounted on the top wall portion of the cavity in proximity to one another, at least one of the barrels having an elevation which differs from the elevation of at least one other barrel;

d. a plurality of channels extending through the top wall portion, each channel connecting one of the barrels with the cavity and forming flow paths for said gas pressure from the cavity to the barrels for propelling said projectiles out of the barrels, at least one of the channels having a cross-sectional area which differs from the cross-sectional area of at least one other channel;

e. the cross-sectional area of each of the channels being substantially smaller than that of the respective barrel associated therewith, thereby causing the gas flow from the cavity into each barrel to reach critical velocity during at least part of the launching course.

2. Apparatus according to claim 1, including support means inside each barrel for supporting a projectile loaded therein in a position providing clerance between the top of the channel associated with said barrel and the trailing end of said projectile, said clearance having a length at least equal to the diameter of the respective barrel.

3. Apparatus for launching a plurality of projectiles, comprising a. a cavity having bottom, side and top wall portions;

b. a receptacle in communication with the cavity for receiving a cartridge providing on its explosion a gas pressure in the cavity;

c. a plurality of barrels for receiving projectiles, the barrels being mounted on the top wall portion of the cavity in proximity to one another and projecting from said wall portion;

d. a plurality of channels extending through the top wall portion, each channel connecting one of the barrels with the cavity and forming flow paths for said gas pressure from the cavity to the barrels for propelling said projectiles out of the barrels;

e. the cross-sectional area of each of the channels being substantially smaller than that of the respective barrel associated therewith, thereby causing the gas flow from the cavity into each barrel to reach critical velocity during at least part of the launching course;

f. at least one of the channels having a cross-sectional area which differs from the cross-sectional area of at least one other channel.

* * * * *